US010178887B1

(12) United States Patent
Chen

(10) Patent No.: US 10,178,887 B1
(45) Date of Patent: Jan. 15, 2019

(54) LIGHTED ARTIFICIAL TREE WITH DISTRIBUTED LIGHTING POWER AND CONTROL

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 569 days.

(21) Appl. No.: 14/557,037

(22) Filed: Dec. 1, 2014

Related U.S. Application Data

(60) Provisional application No. 61/911,268, filed on Dec. 3, 2013.

(51) Int. Cl.

| | |
|---|---|
| ***F21S 6/00*** | (2006.01) |
| ***A41G 1/00*** | (2006.01) |
| ***F21V 23/00*** | (2015.01) |
| ***F21V 23/06*** | (2006.01) |
| *F21W 121/00* | (2006.01) |
| *F21Y 101/02* | (2006.01) |

(52) U.S. Cl.
CPC ..... *A41G 1/005* (2013.01); *A41G 1/007* (2013.01); *F21V 23/001* (2013.01); *F21V 23/003* (2013.01); *F21V 23/06* (2013.01); *F21W 2121/00* (2013.01); *F21Y 2101/02* (2013.01)

(58) Field of Classification Search
CPC ..... A41G 1/005; A41G 1/007; F21V 23/001; F21V 23/003; F21V 23/06
USPC ..... 362/123, 249.18, 249.19
See application file for complete search history.

(56) References Cited

U.S. PATENT DOCUMENTS

| | | | | |
|---|---|---|---|---|
| 4,020,201 | A | 4/1977 | Miller | |
| 5,639,157 | A * | 6/1997 | Yeh | F21S 4/10 362/123 |
| 6,752,512 | B2 | 6/2004 | Pan | |
| 6,794,825 | B1 | 9/2004 | Kao | |
| 8,053,042 | B1 * | 11/2011 | Loomis | A47G 33/06 362/123 |
| 8,454,186 | B2 | 6/2013 | Chen | |
| 8,467,722 | B2 | 6/2013 | Spector | |

(Continued)

FOREIGN PATENT DOCUMENTS

| | | |
|---|---|---|
| DE | 8436328.2 | 4/1985 |
| FR | 1215214 | 4/1960 |

*Primary Examiner* — Anh Mai
*Assistant Examiner* — Meghan Ulanday
(74) *Attorney, Agent, or Firm* — Christensen, Fonder, Dardi & Herbert PLLC

(57) ABSTRACT

A lighted artificial tree that includes a first tree section including a trunk, wiring assembly and trunk electrical connector; a second tree section including a trunk, wiring assembly and trunk electrical connector; a distributed light power and control system, including: a primary controller and a plurality of sub-controllers, each of the plurality of sub-controllers in electrical communication with the primary controller; and a plurality of lighting elements, each of the plurality of lighting elements in direct electrical communication with one of the plurality of sub-controllers. The trunk electrical connector of the first tree section couples to the second trunk electrical connector such that power is conducted from the first tree section to the second tree section, and the primary controller controls each of the plurality of sub-controllers, and each of the plurality of sub-controllers selectively powers each of the plurality of lighting elements to create a lighting effect.

20 Claims, 7 Drawing Sheets

(56) References Cited

U.S. PATENT DOCUMENTS

| | | | | |
|---|---|---|---|---|
| 8,568,015 | B2 | 10/2013 | Chen | |
| 8,863,416 | B2 | 10/2014 | Leung et al. | |
| 9,593,831 | B2 | 3/2017 | Yu | |
| 2006/0164834 | A1* | 7/2006 | Kao | A47G 33/06 362/249.01 |
| 2007/0159109 | A1* | 7/2007 | Gibboney | F21S 4/10 315/185 S |
| 2013/0119893 | A1* | 5/2013 | Chen | A47G 33/06 315/294 |
| 2014/0334134 | A1* | 11/2014 | Loomis | A41G 1/005 362/123 |
| 2015/0070878 | A1* | 3/2015 | Yu | F21V 23/06 362/123 |

* cited by examiner

LIGHTED ARTIFICIAL TREE WITH DISTRIBUTED LIGHTING POWER AND CONTROL

PRIORITY CLAIM

The present application claims the benefit of U.S. Provisional Application No. 61/911,268 filed Dec. 3, 2013, which is incorporated herein by reference in its entirety.

FIELD OF THE INVENTION

The present invention is generally directed to lighted artificial trees. More specifically, the present invention is directed to lighted artificial trees having distributed power and control functions.

BACKGROUND OF THE INVENTION

Artificial lighted trees often include decorative light strings distributed about the branches of the trees. Such decorative light strings may be of the traditional type having power plugs that may be connected to one another, and to an external power supply. Such well known configurations require that multiple power plugs of multiple light strings be plugged in, resulting in a web of wires wound about the branches of the tree.

Not only are such traditional systems tedious to assemble, but such systems provide limited control of the individual light strings and their lamps.

SUMMARY

Embodiments of the invention include lighted artificial trees having distributed power and control systems that enable convenient, safe assembly of tree sections and improved control over lighting elements of the lighted artificial tree. In an embodiment, powered tree sections couple together via internal trunk electrical connectors that make electrical connections between the tree sections. In some embodiments, the trunk electrical connectors are four-terminal connectors that transmit two kinds of electrical power, such as AC and DC, from one tree section to another tree section. In another embodiment also having four-terminal connectors, only one power type is transferred between tree sections via a pair of terminals, while another pair of terminals is used to transmit data communication from one tree section to another tree section. In one such embodiment, the tree includes a single, master controller, and multiple secondary controllers, such as at least one secondary controller for each tree section.

The use of a master controller and multiple secondary controllers reduces the amount of wiring needed to control the many lighting elements of the tree, which may range from 300-1,000 lights for a single tree. The use of a master controller to provide commands to multiple secondary controllers reduces the need to connect a master controller in one tree section to multiple lighting elements, or groups of lighting elements, on another tree section. Such a configuration, namely a master controller at a first tree section directly controlling lighting elements of another tree section, would require trunk electrical connectors with many more than four electrical terminals, or more than four electrical pathways, between tree sections, for an internally-wired, trunk-connected lighted artificial tree.

An embodiment of the invention comprises a lighted artificial tree, comprising: a first tree section including a trunk, wiring assembly and trunk electrical connector; a second tree section including a trunk, wiring assembly and trunk electrical connector; a distributed light power and control system, including: a primary controller including a processor, a plurality of sub-controllers, each including a processor, each of the plurality of sub-controllers in electrical communication with the primary controller; a plurality of lighting elements, each of the plurality of lighting elements in direct electrical communication with one of the plurality of sub-controllers; wherein the trunk electrical connector of the first tree section is configured to couple to the second trunk electrical connector such that power is conducted from the first tree section to the second tree section, and the primary controller controls each of the plurality of sub-controllers, and each of the plurality of sub-controllers selectively powers each of the plurality of lighting elements to create a lighting effect.

Another embodiment of the invention comprises a distributed lighting power and control system for an artificial lighted tree, comprising: a primary controller including a processor, a plurality of sub-controllers, each including a processor, each of the plurality of sub-controllers in electrical communication with the primary controller; a plurality of lighting elements, each of the plurality of lighting elements in direct electrical communication with one of the plurality of sub-controllers; wherein the primary controller controls each of the plurality of sub-controllers, and each of the plurality of sub-controllers selectively powers each of the plurality of lighting elements according to commands issued by the primary controller.

BRIEF DESCRIPTION OF THE FIGURES

The invention can be understood in consideration of the following detailed description of various embodiments of the invention in connection with the accompanying drawings, in which.

Figure 1:
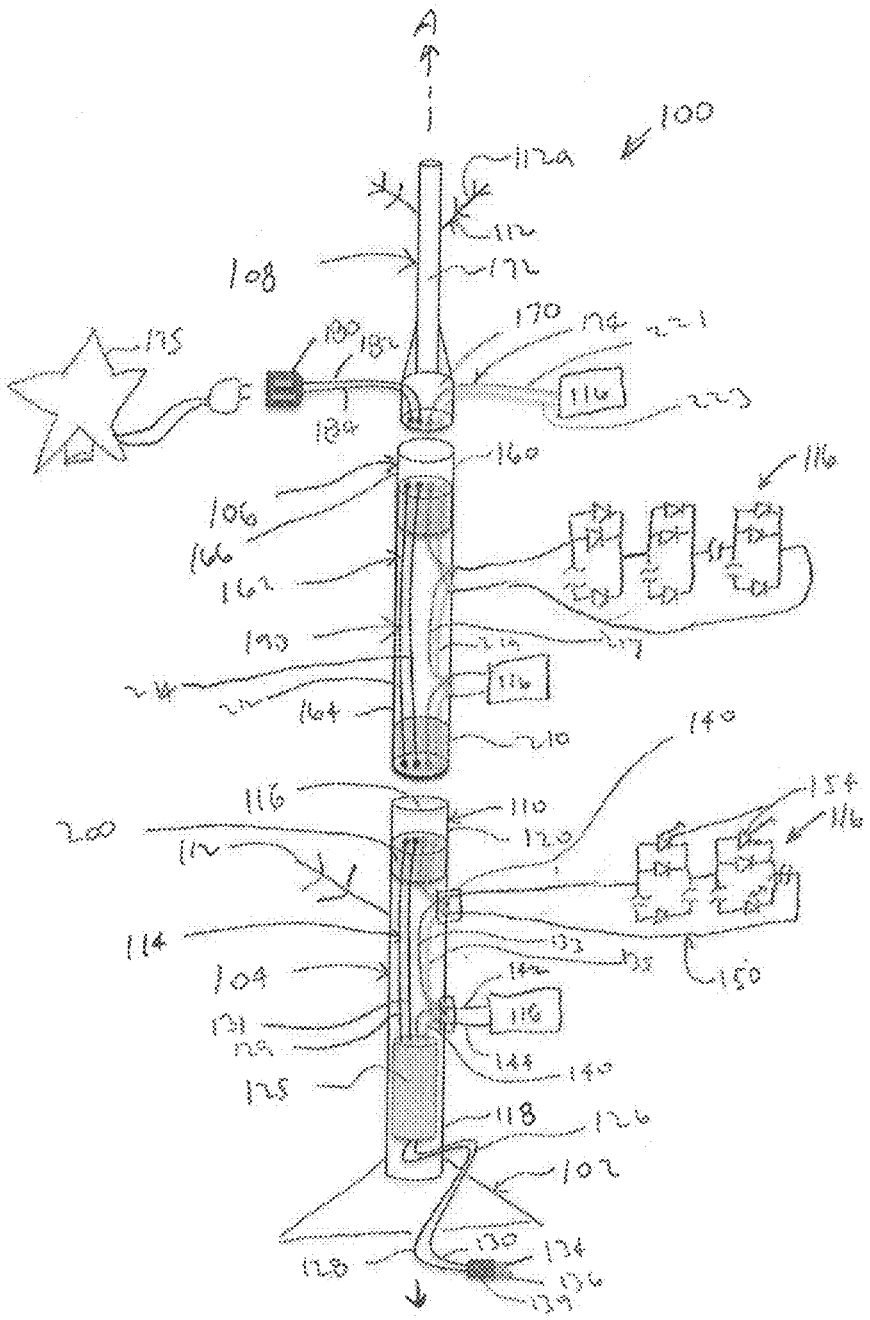
FIG. 1 depicts a lighted artificial tree having a distributed lighting power and control system, according to an embodiment of the claimed invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIG. 1, an embodiment of an improved lighted artificial tree 100 with a dual-voltage electrical system is depicted. In an embodiment, and as depicted, tree 100 includes base 102 and a plurality of tree sections, including first tree section 104, second tree section 106, and third tree section 108. Although tree 100 as depicted includes three tree sections, it will be understood that tree 100 may include more or fewer tree sections.

As will be described further in greater detail, tree 100 is configured to receive power from an external power supply, which may be an alternating-current (AC) power source, with power being distributed through trunks of each tree section to power lights distributed about the tree. Embodiments of tree 100, though improved, are similar to embodiments of lighted trees described in U.S. Pat. No. 8,434,186 issued Jun. 4, 2013 and entitled Modular Lighted Tree, and US Pub. No. 2013/0163231, published Jun. 27, 2013 and entitled Modular Lighted Artificial Tree, both of which are incorporated by reference herein in their entireties.

Tree section 104 includes trunk portion 110, a plurality of branches 112, wiring assembly 114, and a plurality of decorative light strings 116, each having a plurality, or quantity "N" of lighting elements 154.

In an embodiment, trunk portion 110 defines a generally cylindrical body having proximal or bottom end 118 and distal or top end 120. Bottom end 118 is configured to be received by base 102, thereby securing tree section 104 in a generally vertical orientation along Axis A. Top end 120 is configured to receive a portion of tree section 106, as will be described further below. Trunk portion 110 may define a generally hollow body, or alternatively, may be partially hollow, defining trunk cavity 122. In an embodiment, cavity 122 extends from bottom end 118 to top end 120.

Branches 112 are coupled to trunk portion 110, and extend outwardly and away from trunk portion 110. In an embodiment, a branch 112 comprises a branch support portion that includes a metal rod, which in an embodiment, comprises a solid-core rod, such as a length of stiff metal wire. Branches support portions of branches 112 may include a single metal rod, or may include multiple metal rods twisted about one another to form a twisted metal support rod. Strips or portions of plastic material may be attached to the branch support portions to simulate artificial pine needles or other leaf or tree features.

Wiring assembly 114, in an embodiment, includes power cord portion 126. Power cord 126, in an embodiment, includes first conductor 128, which may be of a first electrical polarity, second conductor 130, which may be of a second electrical polarity, and power plug 132. Power plug 132, in an embodiment, includes first electrical terminal 134, second electrical terminal 136, and housing 139. In an embodiment, power plug 132 may include a fuse. First electrical terminal 134 is electrically connected to first conductor 128, through the fuse when present; second electrical terminal 136 is electrically connected to second conductor 130. In an embodiment in which tree 100 receives alternating-current (AC) power, first conductor 128 conducts a "line", "hot", or positive electrical signal, while second conductor 130 conducts a neutral or ground electrical signal.

Wiring assembly 114 also includes a wiring portion 140 located within trunk cavity 122 with portions also extending outside trunk portion 110. Light strings 116 are configured to attached to light-string connector assemblies so as to electrically connect each light string 116 to a source of power from inside trunk portion 110.

In an embodiment, and as depicted, each light-string 116 includes a first wire 142 and a second wire 144. In an embodiment, first wire 142 and terminal 143 are in electrical communication with first power cord wire 128 and second wire 144 and terminal 145 are in electrical communication with second power cord wire 130.

In another embodiment, not depicted, wiring portions 140 also include additional wire electrical connectors electrically connected to first and second wires 142 and 144, respectively.

Light strings 116 are in electrical connection or communication with light string connector assemblies 140. In an embodiment, wiring portions of light-string connectors 140 form a portion of light string 116. In other embodiments, light strings 116 may be detachably coupled to light-string connector assemblies 140 via one or more connectors.

Light strings 116 generally include light string wiring 150, sockets 152 and lighting elements 154. Light string wiring 150 comprises, or is in electrical connection with, wires 142 and 144, and thereby is in electrical communication with power cord 126.

Lighting elements 154 may include any of a variety of lights or lamps, including incandescent bulbs, light-emitting diodes (LEDs), a combination of different lights, lamps or LEDs, and so on. In some embodiments, lighting elements 154 of a common tree 100 may all have the same power requirement. In other embodiments, lighting elements 154 may have differing power requirements, such as a tree 100 that includes both light strings 116 having LEDs and operating on DC power, and light strings 116 having incandescent bulbs and operating on AC power.

In an embodiment, groups or "strings" of lighting elements may be in electrical connection with a sub-controller, but not in electrical connection with one another. Such an embodiment disposes of traditional "light strings", and allows for complete control over each and every individual lighting element 154, as described further below.

Alternatively, lighting elements 154 may be electrically connected to one another. Lighting elements 154 may be electrically connected in series, such that light string 116 comprises a series-connected light string. Lighting elements 154 may also be configured in a series-parallel configuration, such that a first group of lighting elements 154 are electrically configured in series, a second group of lighting elements 154 are electrically connected in series, and the first group and the second group are electrically connected in parallel. In another embodiment, lighting elements 154 are electrically connected in parallel. In another embodiment, groups of lighting elements 154 are electrically connected in parallel, and the groups are electrically connected in series, to form a parallel-series connected light string 116, as depicted.

Tree section 104 also includes a trunk electrical connector for electrically connecting tree section 104 to tree section 106.

In an embodiment, tree section 106 is similar to tree section 104, though tree section 106 generally does not include power cord 126, some power conversion and conditioning electronics, and includes a first trunk electrical connector and a second trunk electrical connector, as described further, to electrically connect tree section 106 to tree sections 104 and 108.

As such, tree section 106 includes trunk portion 160, branches 112, wiring assembly 162, and light strings 116. Similar to tree section 104, and its wiring assembly 114, portions of wiring assembly 162 may extend from inside trunk portion 160 to outside trunk portion 160 so as to electrically connect to light strings 116.

Trunk portion 160 includes first or bottom end 164, second or top end 166, and defines trunk cavity 168. In an embodiment, bottom end 164 may be tapered, or otherwise configured to fit into top end 120 of trunk portion 110 so as to couple trunk portion 110 to trunk portion 160. In other embodiments, top portion 120 may be tapered to fit into bottom portion 164. In other embodiments, other mechanical trunk coupling configurations may be used, including a coupling device that joins the two trunk portions. Other embodiments for coupling the trunk portions may also be used.

Tree section 108, in an embodiment and as depicted may not include a trunk portion similar to trunk portions of tree sections 104 and 106, but rather, may include a trunk connector 170 and a mast 172, as well as wiring assembly 174 and lights 116. In an alternate embodiment, tree section 108 may be similar to tree section 106, and include a trunk portion similar to trunk portion 160, rather than connector 170 and mast 172.

In an embodiment, trunk connector 170 mechanically and electrically connects tree section 108 to tree section 106, and is configured to be inserted into top end 166 of tree section 106.

In an embodiment, mast 172 is coupled to connector 170 and supports branches 112. In an embodiment, mast 172 comprises a plastic material. Mast 172 may generally comprise an outside diameter that is smaller than an outside diameter of trunk portions 110 and 160, and in an embodiment, may be configured to be received at a top end by an optional electrified tree-top ornament 175.

Wiring assembly 174, in addition to wiring and connectors for light strings 116, may also include an accessory power connector 180 for supplying power to tree-top ornament 175. Accessory power connector 180, in an embodiment includes first wire 182, second wire 184, and receptacle 186. First and second wires 182 and 184 are in electrical connection with power cord 114 to receive power from an external source, which may provide power not only to light strings 116, but also to tree-top ornament 175, or other accessories added to tree 100. Power receptacle 186 includes a pair electrical terminals electrically connected to wires 182 and 184, and which are configured to make contact with the electrical terminals of a power plug of tree-top 174, or another electrified accessory.

In an embodiment, tree 100 makes two types of power, which may have two different voltages, available to electrified elements, such as light strings 116 and ornaments 175. In one such embodiment, accessory power connector provides AC power to connected devices, while light string connectors of each tree section provide DC power to connected devices. In one such embodiment, accessory power connector 180 provides AC power, such as 120 VAC to tree-top ornament 175, while tree sections 106 and 108 and their respective light-string connectors 140 provide DC power to LED-based light strings 116.

Tree 100 includes tree wiring system 190 includes first wire assembly 114, second wire assembly 162, and third wire assembly 174.

Wire assembly 114 includes wiring having primary or first-voltage-type power wires 128 and 130 (of power cord 126), multiple sets of light string connection assemblies 140, and trunk electrical connector 200.

Assembly 114 also includes power conditioning circuitry 125, which may comprise a power transformer, adapter, or converter, as well as other power-conditioning electronics. In an embodiment, power-conditioning circuitry 125 comprises a transformer, which in an embodiment comprises an AC-to-DC power transformer. In one such embodiment, the transformer converts 120 VAC power to a DC power, such as 3 VDC, 9 VDC, 24 VDC, or other DC voltage.

Wiring assembly 114 also includes additional primary power wires 129 and 131 conducting a first power type, and main light-string power wires or bus wires 133 and 135 conducting a second power type. Primary power wires 129 and 131 generally comprise a first electrical polarity wire and a second electrical polarity wire, respectively, and conduct or transmit power of a first type, such as AC power, from power cord 126 up to trunk electrical connector 200.

Consequently, power plug terminal 134, wire 126, and wire 129 are in electrical connection, conducting a first polarity electrical signal from power plug 132 to connector 200; power plug terminal 136, wire 128, and wire 131 are in electrical connection, conducting a second polarity electrical signal from power plug 132 to electrical connector 200. As such, power of a first type, which may be AC power, is transmitted from power plug 126 through tree section 104, and to the top of tree section 104 at first trunk connector 200.

In an embodiment, power conditioning circuitry 125 may be located within trunk cavity 122 or outside of trunk cavity 122. In an embodiment of the latter, power conditioning circuitry 125 or its transformer may be located outside of trunk portion 110 and between power plug 132 and trunk portion 110. In another embodiment, power-conditioning circuitry 125 may be integrated into power plug 132. In such an embodiment, power plug 132 may output two pairs of power wires to tree section 104, one pair transmitting power of a first type, such as AC power, and another pair transmitting power of a second type, such as DC power.

In an embodiment, wire 126 may be connected to wire 129, and wire 128 may be connected to wire 131 inside housing 151 that is common to power conditioning circuitry 125.

Primary power wires 126 and 128 also electrically connect to power-conditioning circuitry 125 and/or transformer at connection points or terminals. Incoming first-type power is converted or transformed into outgoing second-type power at an output of the transformer. In an embodiment, AC power at an input to transformer 127 may be converted to DC power at the output of the transformer.

Power of a second type, such as DC power is transmitted from power conditioning circuitry 125 to wires 133 and 135, which in turn is transmitted to wire pairs 142 and 144 so as to power light strings 116.

In an embodiment, electrical connector 200, as described further below, also includes two pairs of electrical terminals, a first pair conducting power of a first power type comprising terminals 201 and 203, and a second pair conducting power of a second power type comprising terminals 202 and 204. Terminals 201 to 204 are in electrical connection with wires 129, 131, 133, and 135, respectively, of wiring assembly 214, and are configured to electrically connect to wiring assembly 162 when tree section 104 is coupled to tree section 106.

Alternatively, electrical connector 200 includes only a single pair of electrical terminals.

In an embodiment not depicted, electrical connector 200 may include a trunk fuse that is electrically in line with wire 129, which is generally a live or hot conductor.

The primary fuse protects against excessive current draw occurring in any portion of tree 100. Such excessive current draw could be the result of shorting of primary power wires, defective or malfunctioning light strings and so on. A tree-section fuse, when present, provides an additional degree of over-current protection for tree 100 by protecting against excessive current draw in any device electrically connected to wires 129 and 130, or against overcurrent occurring when a foreign object comes into contact with electric terminals of connector 200 or other wiring carrying a first power type.

Power wires 133 and 135, transmitting first polarity power and second polarity power, respectively, to light strings 116, may generally traverse the length of trunk portion 110, connecting to pairs of light string wires 142 and 144 inside, or in some embodiments, outside trunk portion 110. Electrical connection of wires 142 and 144 to main or bus light string power wires 133 and 135 may be made at a connector 140, or may be made by a wire-to-wire connection apart from connectors 140, such as via crimping, soldering, and so on.

Second wiring assembly 162 is similar to first wiring assembly 114, although second wiring assembly 162 may not include power cord 126 nor power conditioning circuitry 125.

In an embodiment, second wiring assembly 162 includes trunk electrical connectors 200 and 210, which will be described further below, first power-type power wires 212 and 214, second power-type or voltage-type power wires 217 and 219, light-string connector assemblies 140 with pairs of light-string wire portions 142 and 144.

As will be described further below, trunk electrical connector 210 is electrically similar to trunk electrical connector 200. Trunk electrical connector 210 may include a tree-section fuse (not depicted), and two pairs of conductive electrical terminals, a first pair 213 and 215 configured to electrically connect to terminals 202 and 204 via wires 212 and 214, respectively, so as to make electrical connection between tree sections 104 and 106, such that power of a first type is transmitted from primary power wires 128 and 130 to power wires 212 and 214, respectively, and a second pair of terminals 221 and 223 configured to electrically connect to terminals 202 and 204, respectively, such that power of a second type is transmitted from power wires 133 and 135 to power wires 217 and 219 of connector 200 of tree section 106.

Power wires 217 and 219 are electrically connected to light strings 116 of tree section 106 via pairs of light-string power wires 142 and 144.

Consequently, power or voltage of a first type is conducted through tree section 106, and power or voltage of a second type is also conducted through tree section 106, and provides second-type power to light strings 116.

In an embodiment, wiring assembly 174 includes power wires 182 and 184, which in an embodiment, are live, hot, or positive, and neutral, ground, or negative, thereby providing first-type power from terminals 216 and 218 to power-plug receptacle 180. Wiring assembly 174 includes power-plug receptacle 180 and light-string wiring 140. Wiring assembly 174 may also include a fuse located within end connector power receptacle 180 or within connector 170, in line or series with power wire 134 and terminal 216.

Wiring assembly 114 also includes terminals 221 and 223 electrically connected to one or more light-string power wires 142 and 144, thereby providing power of a second type to light strings 116 of tree section 108.

Consequently, when tree sections 104, 106, and 108 are coupled together, electric terminals of connectors 200 and 210 make electrical connection, connector 200 terminals connect with connector 174, wiring assemblies 114, 162, and 174 are thereby in electrical connection, and power or voltage of a first type is transmitted from power cord 126 throughout tree 100, providing power to accessory power-plug receptacle 180 (and individual tree sections in some embodiments), and power or voltage of a second type is transmitted from power conditioning circuitry 125 to each tree section 104, 106, and 108 and their respective light strings 116.

Figure 2:
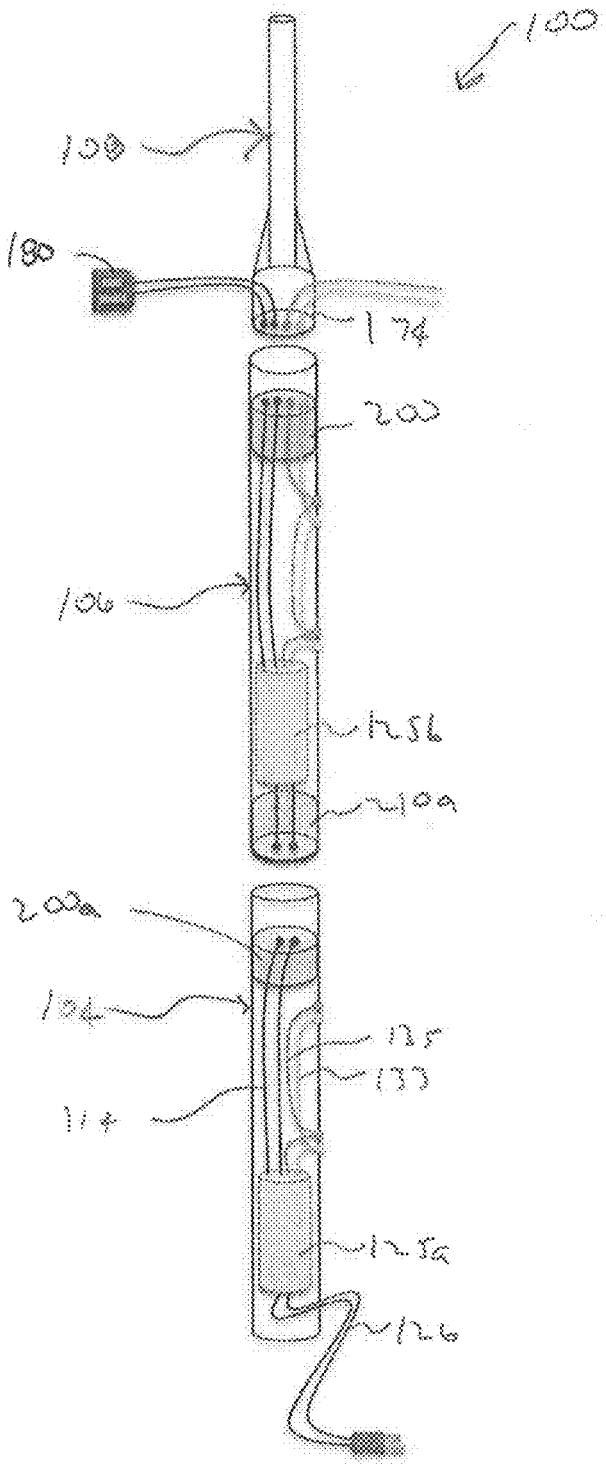
FIG. 2 depicts a lighted artificial tree having a distributed lighting power and control system, according to another embodiment of the claimed invention.

Referring to FIG. 2, in an alternate embodiment, tree 100 includes power conditioning circuitry in more than one tree section.

Tree 100 of FIG. 2, in the depicted embodiment, transmits power of only a first type, such as AC, power between tree section 104 and 106. In such an embodiment, trunk electrical connector 200 of tree section 104 comprises a 2-terminal or pin connector 200*a* (which may be a female connector) and trunk electrical connector 210 of tree section 106 comprises a 2-terminal connector 210*a* (which in an embodiment may be a male connector).

Further, tree section 104 includes power conditioning circuitry 125*a* and tree section 106 includes power conditioning circuitry 125*b*. Distributing the power conditioning function to more than one tree section allows for smaller transformers which may decrease heat buildup in, on, or in the vicinity of the tree sections.

Figure 3:
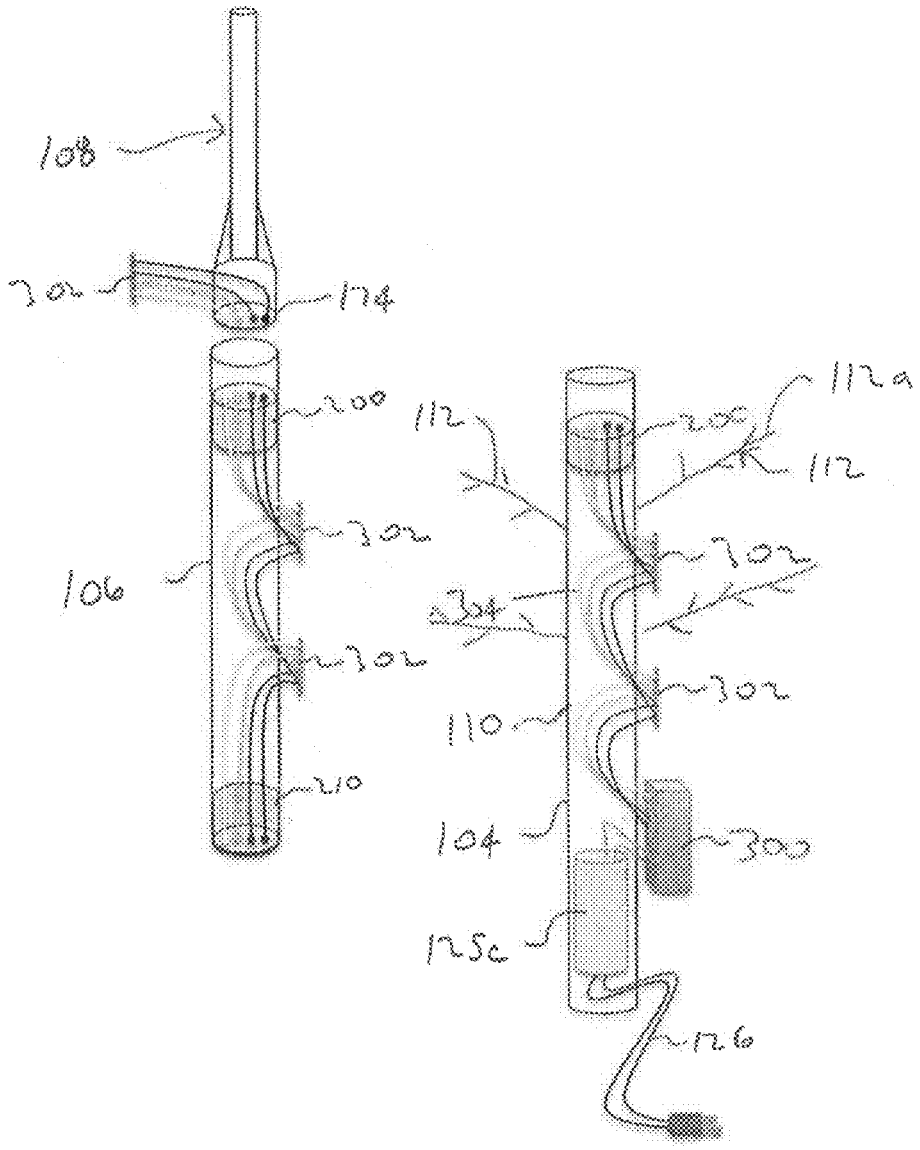
FIG. 3 depicts a lighted artificial tree having a distributed lighting power and control system, according to yet another embodiment of the claimed invention.

Referring to FIG. 3, another embodiment of tree 100 is depicted. Although the base, branches, light strings and other components are not depicted in FIG. 3, it will be understood that tree 100 of FIG. 3 also includes these elements, though for the sake of brevity, will not be depicted and described again in detail.

In this embodiment, tree 100 includes at least one primary external controller 300 and one or more sub-controllers 302.

In this embodiment, tree section 104 includes power-conditioning circuitry 125*c*, which transforms power from a first voltage type, such as AC power, to power of a second type, such as DC power. Although not depicted, power-conditioning circuitry 125*c* may also be configured to bypass power of the first type through tree section 104, up to tree sections 106 and 108, as depicted and described above with respect to tree 100 of FIG. 1 or 2.

Controller 300, in an embodiment, includes a computer, microcomputer, processor, controller, microcontroller, or other such computing or controlling device. Controller 300 may also include memory, additional power conditioning components, and other electrical components.

Wiring assembly 304 electrically connects controller 300 to each sub-controller 302, such that controller 300 is in electrical communication with each sub-controller 302. Wiring assembly 304 also electrically connects controller 300 to trunk electrical connector 200. Trunk electrical connector 200 includes multiple terminals, such as the four terminals depicted, and when tree section 104 is joined to tree section 106 trunk electrical connectors 200 and 210 are electrically connected. This also creates an electrical connection between controller 300 and sub-controllers 302 of tree section 106. Similarly tree section 108 is electrically connected to tree section 106 via connectors 174 and 200 of tree section 106.

In this manner, and in this particular embodiment, controller 300 is in electrical communication with all sub-controllers 302 of all tree sections, and provides power to each sub-controller 302.

In an embodiment, and as depicted, controller 300 comprises a 4-wire output to each sub-controller, though the number of outputs, output channels, and so on may be more or fewer. A four-wire output allows for multiple outputs for power and for communication. In an embodiment, two outputs conduct power to sub-controllers 302, and two are dedicated for communication.

In an embodiment, controller 300 may be configured to communicate wirelessly with a remote control device, such as a smart phone. Wireless communication may be accomplished over any variety of known wireless networks such as Wi-Fi, Bluetooth, Zigbee, radio-frequency (RF), Z-Wave, and so on. In such an embodiment, controller 300 may include a radio chip and antenna for wireless communication. In one such embodiment, and as depicted, controller 300 may be located external to the trunk portion of a tree section so as to increase wireless connection capability, by improving wireless reception. In an embodiment, locating controller 300 outside of trunk portion 110 improves wireless reception by reducing interference that might otherwise occur due to controller 300 being surrounded by trunk portion 110, which in an embodiment, comprises a metal cylinder. In such an embodiment, most other wiring, connector, and other circuitry is located within trunk portion 110, thereby allowing improved reception without removing the features and benefits of an internal wiring system. In other embodiments, controller 300 may be located inside a trunk portion with or without a receiver or antenna that may be outside the trunk portion.

Locating controller 300 outside trunk portion 110, while wiring assembly 114 and its current-carrying conductors are located inside trunk portion 110 may also reduce the amount of EMI experienced by controller 300, thereby improving performance and wireless communication with an external remote control device over a wireless network.

In an embodiment, and as depicted in FIG. 3, controller 300 is located at first trunk portion 110. In one such embodiment, locating controller 300 at first trunk portion, whether inside the trunk portion, or outside, improves wireless reception due to placement of branches 112. In an embodiment, branches 112 (see also FIG. 1), may be affixed to an upper portion of trunk portion 110. In such an embodiment, controller 300 is below branches 112 which in some cases improves wireless reception, or connection to a wireless network or remote control device, and also improves accessibility to a user. Accessibility to a user may be desirable for embodiments of controller 300 that include manual push buttons, switches, etc., for selective operation of controller 300 and the light strings.

However in another embodiment, controller 300 is located at trunk or tree portion elsewhere on tree 100. Rather than being located at trunk portion 110 (tree portion 104), wireless controller 300 may be located at middle tree portion 106 or upper tree portion 108. Locating at a middle tree portion 106 may provide advantages in wiring arrangements. Locating at an upper tree portion 108, particularly when attached to an exterior portion of tree portion 106, may improve wireless reception. Such improved reception can be a factor of minimized branch interference. Branch length of branches 112 generally decreases from a bottom portion of tree 100 to a top portion of tree 100, i.e., branches 112 of tree portion 104 generally are longer than branches 112 of tree portion 108. Consequently, tree portion 108, in an embodiment, has relatively short branches, which may result in less interference, such as electromagnetic interference (EMI), by branches 112, when controller 300 is attached externally to the trunk portion or mast of tree portion 108, as compared to when controller 300 is attached the trunk portion 110 of tree portion 104.

Sub-controllers 302 may be distributed about tree 100, and in an embodiment, include one or more electrical controllers, processors, microcontrollers, microcomputers, or other such computing or processing device. Sub-controllers 302 may also include memory devices to store software or other saved commands for control of light strings 116.

Each sub-controller 302 is in communication with, and in control of, a light string 116, or a plurality of lighting elements 154. In an embodiment, each sub-controller 302 controls 3-10 lighting elements or LEDs 154.

In an embodiment, sub-controller 302 detects if a lighting element 154 fails, such as by sensing current draw etc. In the event of a lighting element 154 failure, sub-controller 302 may adjust the voltage provided to light string 116, or to individual lighting elements 154. This prevents other lighting elements 154 from being affected by the failure of one or more lighting elements 154. Voltage regulation to groups of LEDs is easier to accomplish as compared to trying to detect and adjust voltage to LEDs of an entire tree 100.

Figure 4:
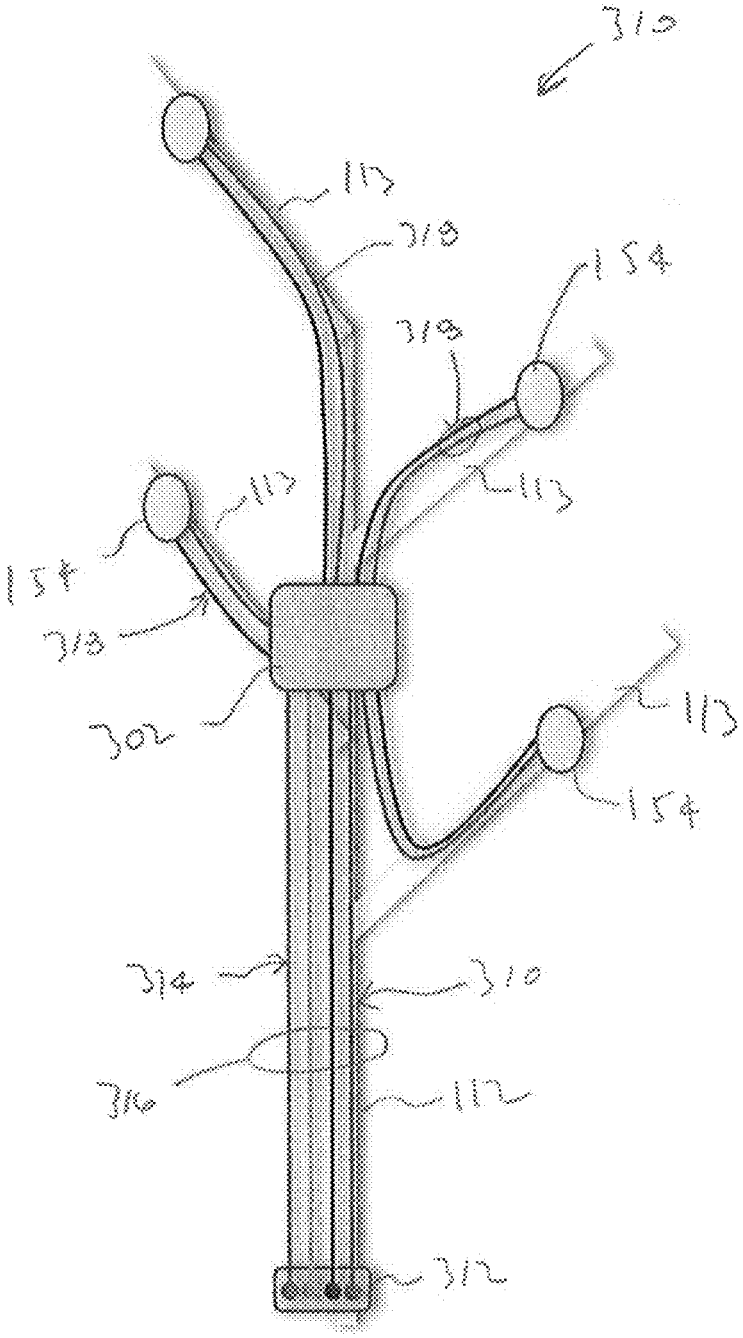
FIGS. 4-6 depict embodiments of a branch wiring system of the claimed invention.
Figure 5:
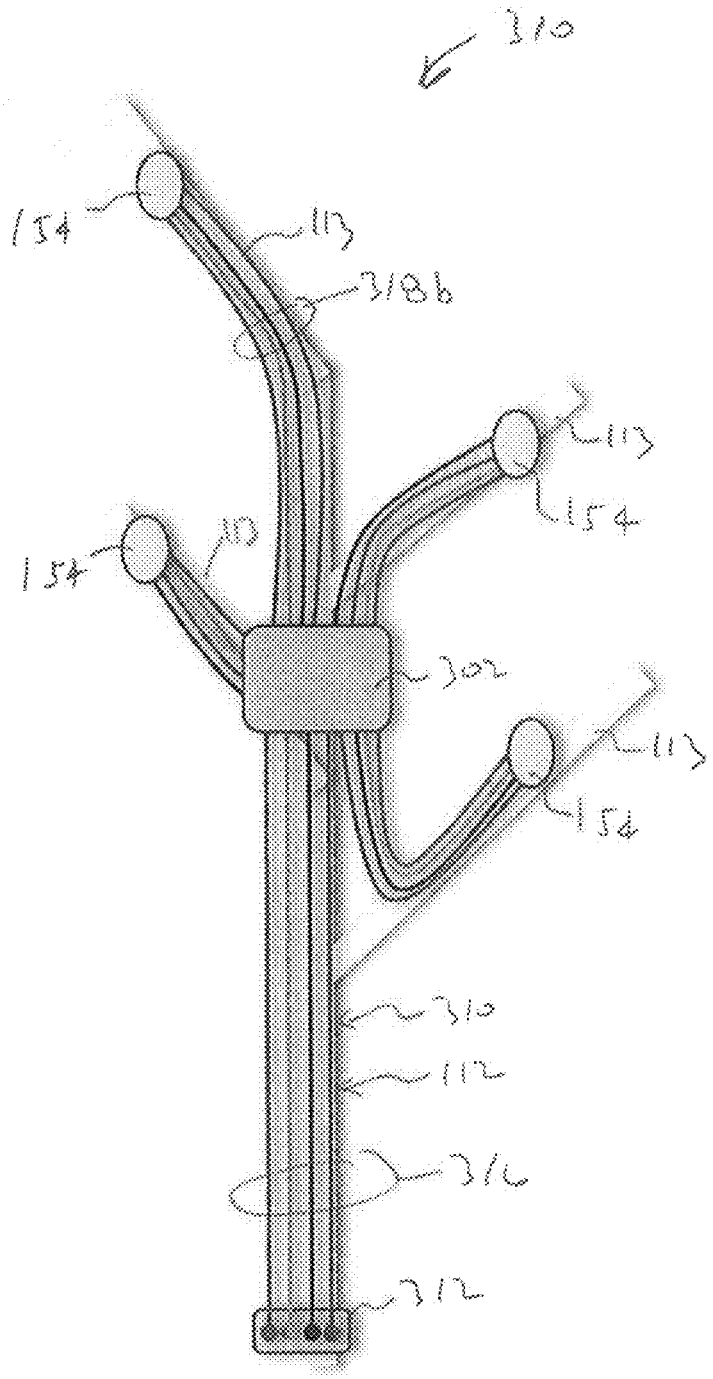
Figure 6:
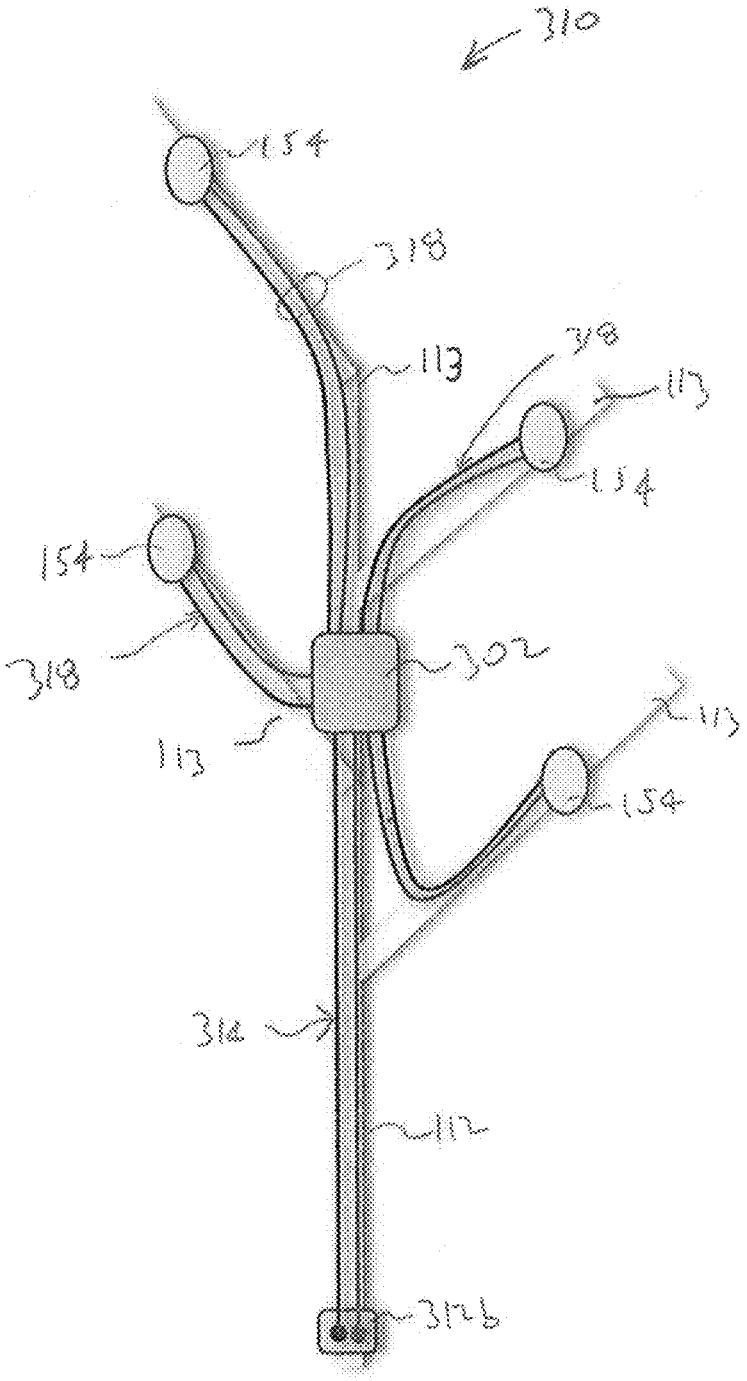

Referring to FIGS. 4-6, several embodiments of wiring configurations for branch systems 310 are depicted. Tree 100, and each tree section, will include multiple branch systems 310.

Referring to FIG. 4, branch system 310 includes branch 112, sub-branches 113, branch-trunk connector 312, and branch wiring 314. Sub-branches 113 may be connected to a main portion of branch 112, and in an embodiment, lighting elements 154 are distributed about branch 112.

Branch-trunk electrical connector 312 is configured to electrically connect sub-controller 302 to main wiring 304 and to controller 300.

Branch wiring 314 includes sub-controller wiring 316 and a plurality of lighting element wire sets 318. In an embodiment, sub-controller wiring 316 comprises four wires for conducting power and communication signals from the trunk to the sub-controller 302. In an embodiment, each lighting element wire set 318 includes a pair of power wires such that sub-controller 302 can selectively control power to each lighting element 154. Controlling power may comprise selectively turning power on and off, lowering voltages to dim lights, creating a twinkle effect, and so on.

Referring to FIG. 5, in an embodiment of branch system 310, sub-controller 302 comprises a four-channel output, such that light string wire sets 318 each comprise four wires. In such an embodiment, lighting elements 154 may comprise a multi-color, multi-chip LED lamp, such as a red-green-blue (RGB) LED lamp, with individual power lines to each LED color (3 power, 1 neutral), such that the four channels or wires to each LED controls the three LED chips to create various color effects. In another embodiment, each lighting element 154 may include its own control chips, so that some of the four channels provide communication and control information transmitted from sub-controller 302 to lighting element 154. Although the number of outputs from sub-controller 302 is depicted as four, more or fewer channels may be used, depending on the characteristics of lighting elements 154 and desired degree of control.

Referring to FIG. 6, an embodiment of branch system 310 is similar to branch system 310 of FIG. 4, though sub-controller wire assembly 316 includes only two wires. In this embodiment, the two wires of wire assembly 316 may provide power to sub-controller 302.

In one such embodiment, sub-controller 302 may include stored algorithms for controlling lighting elements 154, rather than receiving control commands or signals from a main controller 300. In such an embodiment, lighting elements 154 may also be turned on and off by removing power to their respective sub-controller 302.

In another embodiment, sub-controller 302 merely provides voltage regulation to lighting elements 154 via the two-wire lighting element wire sets 318.

Figure 7:
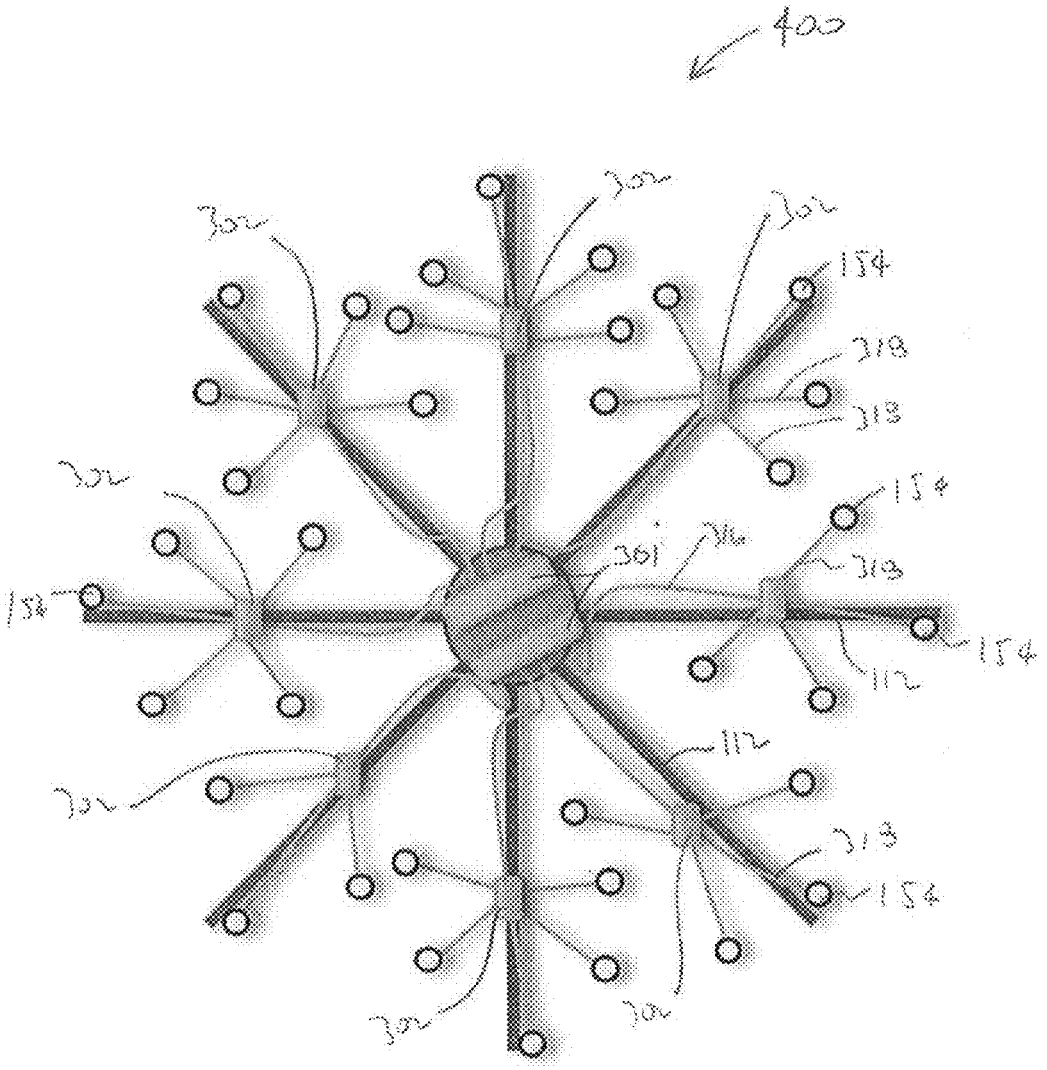
FIG. 7 depicts a hub-based lighting power and control system, according to an embodiment of the claimed invention.

Referring to FIG. 7, another embodiment of a tree 100 wiring and control system 400 is depicted. In this embodiment, branch-wiring and control system 400 includes power hub 301, which may or may not include a controller 300. In an embodiment, power distribution hub 301 is in electrical communication with one or more controllers 300, and distributes power and communication signals to the tree section, including to sub-controllers 302. In an embodiment, system 400 also includes a plurality of sub-controllers 302, light-string control wiring 318, and a plurality of lighting elements 154. In an embodiment, wiring and control system 400 comprises any of the branch-wiring control systems 310 depicted and described with respect to FIGS. 4-6.

In an embodiment, hub 301 is located centrally, at or near a trunk of a tree section of tree 100. In an embodiment, hub 301 is located outside and adjacent to tree 100 trunk portion. In another embodiment, hub 301 is located inside a trunk cavity 122 of the trunk portion.

Hub 301 is in electrical communication with, and controlling, multiple sub-controllers 302. Sub-controllers 302 are distributed about branches 112 of the tree section, such as tree section 104 or 106.

Each sub-controller 302 selectively powers or controls a plurality of lighting elements 154.

In embodiments of the claimed invention, rather traditional light strings 116 may not be used. Rather, each individual lighting element 154 is controlled by a sub-controller 302 or a controller 300, such that optimal control over all lighting elements 154 of tree 100 is accomplished.

The distributed wiring and light control systems described above allows for many different control functions. Such control functions may be stored in memory in controllers 300 and/or sub-controllers 302, or may be transmitted from a control device, such as a remote control device, including a smartphone.

Such a remote control device, particularly a smart phone, may command tree 100 and its control system to play music, set lighting element 154 brightness or color, cause lighting elements 154 to twinkle, how to twinkle, set a timer, and so on. Users of tree 100 may be able to download tree and light functions from an external source through a wide-area or local-area network, then transmit to tree 100 and its controller 300.

In other embodiments, tree 100 may be configured to communicate with a smart phone, interacting with the smart phone, such as, by reacting to incoming phone calls by changing or implementing a particular lighting function, rotate a tree, and so on.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. A lighted artificial tree having distributed electrical power and light control, comprising:

a first tree section including:

a first trunk portion defining a first end, a second end, and a defining a first trunk cavity;

a first plurality of branches attached at a first end to the first trunk portion and extending outward and away from the first trunk portion;

a first plurality of lighting elements distributed about the first plurality of branches;

a first wiring assembly for conducting electrical power, the first wiring assembly located at least partially within the first trunk cavity;

a first trunk electrical connector located at least partially within the first trunk cavity adjacent the first end of the first trunk portion, the first trunk electrical connector being in electrical connection with the first wiring assembly, and including a first connector body and a first plurality of electrical terminals; and a first controller in electrical communication with the first wiring assembly and the first trunk electrical connector;

a second tree section including:

a second trunk portion defining a first end, a second end, and a defining a second trunk cavity;

a second plurality of lighting elements;

a second wiring assembly for conducting electrical power, the second wiring assembly located at least partially within the second trunk cavity;

a second trunk electrical connector located at least partially within the second trunk cavity adjacent the first end of the second trunk portion, the second trunk electrical connector being in electrical connection with the second wiring assembly, and including a second connector body and a second plurality of electrical terminals;

a second controller in electrical communication with the second wiring assembly, the second trunk electrical connector and the second plurality of lighting elements, the second controller configured to selectively power the second plurality of lighting elements in response to light-control data received from the first controller;

wherein the first tree section is configured to couple to the second tree section such that the first end of the first trunk portion couples to the first end of the second trunk portion, thereby causing the first plurality of electric terminals of the first trunk electrical connector to be in electrical connection with the second plurality of electrical terminals of the second trunk electrical connector such that electrical power and the light-control data may be transmitted from the first tree section to the second tree section.

2. The lighted artificial tree of claim 1, wherein the first trunk electrical connector and the second trunk electrical connector each include four electrical terminals.

3. The lighted artificial tree of claim 2, wherein two of the four electrical terminals are configured to transmit electrical power, and two of the four electrical terminals are configured to transmit the light-control data.

4. The lighted artificial tree of claim 2, wherein alternating-current power is transmitted from the first trunk electrical connector to the second trunk electrical connector and direct-current power is transmitted from the first trunk electrical connector to the second trunk electrical connector.

5. The lighted artificial tree of claim 1, wherein the first tree section further includes a third controller, the third controller in electrical communication with the first controller, the third controller receiving light-control data from the first controller, and selectively powering the first plurality of lighting elements based on the received light-control data from the first controller.

6. The lighted artificial tree of claim 1, wherein the second tree section further includes a fourth controller and a third plurality of lighting elements, the fourth controller receiving light-control data from the first controller and controlling the third plurality of lighting elements based on the light control data received from the first controller.

7. The lighted artificial tree of claim 1, wherein the first controller is located outside of the first trunk cavity.

8. The lighted artificial tree of claim 7, wherein the first controller is mounted to the trunk portion below the first plurality of branches, such that no branches are below the first controller.

9. A lighted artificial tree having distributed electrical power and light control, comprising:

a first tree section including:

a first trunk portion defining a first trunk cavity;

a first plurality of branches attached at a first end to the first trunk portion and extending outward and away from the first trunk portion;

a first plurality of lighting elements distributed about the first plurality of branches;

a first wiring assembly for conducting electrical power and light-control data, the first wiring assembly located at least partially within the first trunk cavity;

a first trunk electrical connector located at least partially within the first trunk cavity adjacent the first end of the first trunk portion, the first trunk electrical connector being in electrical connection with the first wiring assembly, and including a first connector body and a first plurality of electrical terminals; and a primary tree controller in electrical communication with the first wiring assembly and the first trunk electrical connector, the primary tree controller including a receiver for receiving wireless communication data from a remote-control device over a wireless network;

a second tree section including:

a second trunk portion defining a first end, a second end, and a defining a second trunk cavity;

a second plurality of lighting elements;

a second wiring assembly for conducting electrical power, the second wiring assembly located at least partially within the second trunk cavity;

a second trunk electrical connector located at least partially within the second trunk cavity adjacent the first end of the second trunk portion, the second trunk electrical connector being in electrical connection with the second wiring assembly, and including a second connector body and a second plurality of electrical terminals;

a first secondary controller in electrical communication with the second wiring assembly, the second trunk electrical connector and the second plurality of lighting elements, the second secondary controller configured to selectively power the second plurality of lighting elements in response to light-control data received from the primary controller;

wherein the first tree section is configured to couple to the second tree section such that a first end of the first trunk portion couples to a first end of the second trunk portion, thereby causing the plurality of first electric terminals of the first trunk electrical connector to be in electrical connection with the second plurality of electrical terminals of the second trunk electrical connector such that electrical power and the light-control data may be transmitted from the first tree section to the second tree section.

10. The lighted artificial tree of claim 1, wherein the receiver of the primary controller is located outside of the first trunk cavity.

11. The lighted artificial tree of claim 10, wherein the receiver comprises an integrated circuit configured to operate at a radio frequency and an antenna, and the receiver is located below the first plurality of branches, such that all branches of the first tree portion are above the receiver.

12. The lighted artificial tree of claim 9, wherein the primary controller is configured to receive a WiFi or Bluetooth wireless signal.

13. The lighted artificial tree of claim 9, wherein the first plurality of electrical terminals of the first trunk electrical connector comprises four electrical terminals.

14. The lighted artificial tree of claim 13, wherein two of the four electrical terminals are electrically connected to two conductors of the first wiring assembly, the two conductors of the first wiring assembly configured to conduct electrical power, and two of the four electrical terminals are electrically connected to the primary controller and are configured to transmit light-control data.

15. The lighted artificial tree of claim 9, wherein the primary controller comprises a processor and a memory, the memory storing the light-control data.

16. A lighted artificial tree, comprising:

a first tree section including a trunk, wiring assembly and trunk electrical connector, the trunk of the first tree section having a first end and a second end;

a second tree section including a trunk, wiring assembly and trunk electrical connector, the trunk of the second tree section having a first end and a second end, and defining a cavity between the first end and the second end, at least a portion of the wiring assembly located within the cavity of the trunk of the second tree section, and in electrical connection with the trunk electrical connector of the second tree section;

a distributed light power and control system, including:

a primary controller including a processor, a plurality of sub-controllers, each sub-controller including a processor, each of the plurality of sub-controllers in electrical communication with the primary controller;

a plurality of lighting elements, each of the plurality of lighting elements in direct electrical communication with one of the plurality of sub-controllers;

wherein the first tree section is configured to couple to the second tree section such that the first end of the trunk of the second tree section couples to the second end of the trunk portion of the first tree section, and the trunk electrical connector of the first tree section couples to the trunk electrical connector of the second tree section such that the first tree section is in electrical connection to the second tree section, and the primary controller is in electrical connection with each of the plurality of sub-controllers, and wherein each of the plurality of sub-controllers is configured to selectively power each of the plurality of lighting elements to create a lighting effect.

17. The lighted artificial tree of claim 16, wherein each of the plurality of sub-controllers is mounted to one of a plurality of branches of the second tree section.

18. The lighted artificial tree of claim 16, wherein each of the plurality of lighting elements includes a lighting control circuit and one or more light-emitting diodes.

19. The lighted artificial tree of claim 16, wherein one or more of the plurality of sub-controllers includes a voltage regulation circuit for regulating the voltage to the plurality of lighting elements that are controlled by the one or more of the plurality of sub-controllers, the voltage regulation circuit adjusting the voltage to the plurality of controlled lighting elements in the event of a failure of one or more of the controlled lighting elements.

20. The lighted artificial tree of claim 16, wherein each of the plurality of lighting elements includes a red-green-blue light-emitting diode, and is connected to one of the plurality of sub-controllers by four conductors, a terminal end of each of the four conductors each making a connection at each of the plurality of lighting elements.

* * * * *